United States Patent [19]

Thomas et al.

[11] 4,220,253

[45] Sep. 2, 1980

[54] HINGE STRUCTURE

[75] Inventors: Michael D. Thomas, Arab, Ala.; Francis E. Ryder, Barrington, Ill.

[73] Assignee: Ryder International Corporation, Arab, Ala.

[21] Appl. No.: 955,393

[22] Filed: Oct. 27, 1978

[51] Int. Cl.[2] ..... B65D 43/16

[52] U.S. Cl. ..... 220/338; 16/166; 16/128 R

[58] Field of Search ..... 16/128 R, 171, 191, 16/175, 176, 178, 173, 163, 166; 220/337, 338, 339, 340

[56] References Cited

U.S. PATENT DOCUMENTS

| | | | |
|---|---|---|---|
| 2,742,665 | 4/1956 | Stopek | 16/128 R |
| 2,765,949 | 10/1956 | Hillman | 16/128 R |
| 3,077,282 | 2/1963 | Eggers | 16/128 R |
| 3,140,507 | 7/1964 | Rozmus | 16/128 R |
| 3,371,506 | 3/1968 | Zahn | 16/171 X |
| 3,850,342 | 11/1974 | Dsjuba | 16/171 X |

*Primary Examiner*—George H. Krizmanich
*Attorney, Agent, or Firm*—Trexler, Wolters, Bushnell & Fosse, Ltd.

[57] ABSTRACT

A hinge structure is disclosed for hingedly joining a cover or lid member with a base or housing member of an overall unit, such as a control lens disinfector, or the like. The base or container member carries, in opposing side wall portions, a pair of coaxial, axially spaced cylindrical bores or apertures, while the cover member carries, in opposing side wall portions, a pair of coaxial, axially spaced and oppositely outwardly extending rod-like pins or pintle members. The axial spacing of these pins or pintles is similar to that of the bores or apertures of the base member. A pair of slots or openings are provided in an end wall of the cover member, being generally adjacent the confluences of the respective side walls with the end wall, one such slot being disposed immediately axially inwardly of each of the pin or pintle members. Advantageously, the slots provide for resilient movement of the side wall portions of the cover member adjacent the pin or pintle members. This resilient movement permits inward compression of these side wall portions for alignment of the pin or pintle members with the cooperating base member bores or apertures. Upon cessation of such compression, the cover member side wall portions resiliently return to their original shape, thus inserting the rod-like members for pivotal or rotative movement within their cooperating base member bores to define the assembled hinge structure.

4 Claims, 7 Drawing Figures

HINGE STRUCTURE

BACKGROUND OF THE INVENTION

This invention relates generally to hinges, and more particularly to a hinge structure for pivotally or hingedly joining two members, such as a base or housing and a cover member, to provide an overall container unit, or the like.

While the present invention may find application in a broad variety of situations, the description will be facilitated by reference to the problems of pivotally joining a cover member to a base or housing assembly of a contact lens sterilizing or disinfecting apparatus. In this type of apparatus, the base or housing generally contains the heating unit and includes a well or depression in association with the heating unit, into which a lens case is inserted and placed into contact with the heating unit. This is done to elevate the temperature of a sterilizing solution within the lens case, thereby destroying any bacteria that may be present on the lenses disposed therein. In such apparatus it is desirable to provide a hinged cover or lid member which overlies the lens case and heating unit, to prevent inadvertent contact therewith while the unit is at an elevated temperature, and also to improve the overall aesthetics of the apparatus.

While there are numerous ways to provide for such a pivotal or hinged mounting of a lid or cover, the present invention provides a simple yet reliable hinge structure which is relatively inexpensive to fabricate and moreover can be assembled with a minimum amount of effort and skill, and provides for effective, trouble free pivotal movement.

Briefly, a hinge structure for hingedly joining a base or housing member to a cover or lid member, in accordance with the present invention, comprises pintle means on one of said members to be hingedly joined and cooperating bore means on the other of said members to be hingedly joined for pivotally receiving said pintle means. The pintle means and bore means are generally coaxially alignable and similarly axially spaced. The cover member includes means for allowing resilient compression thereof on the axis of the pintle means, whereby at least a portion of the cover means is resiliently compressible to allow insertion of the pintle means with respect to the cooperating bore means, and thereafter returns to its original shape to maintain pivotal mounting of said pintle means with respect to said cooperating bore means, thereby defining a hinge structure.

BRIEF DESCRIPTION OF THE DRAWINGS

Other objects, features, and advantages of this invention will be appreciated upon consideration of the following detailed description and the accompanying drawings, wherein.

DETAILED DESCRIPTION OF THE ILLUSTRATED EMBODIMENT

Figure 1:
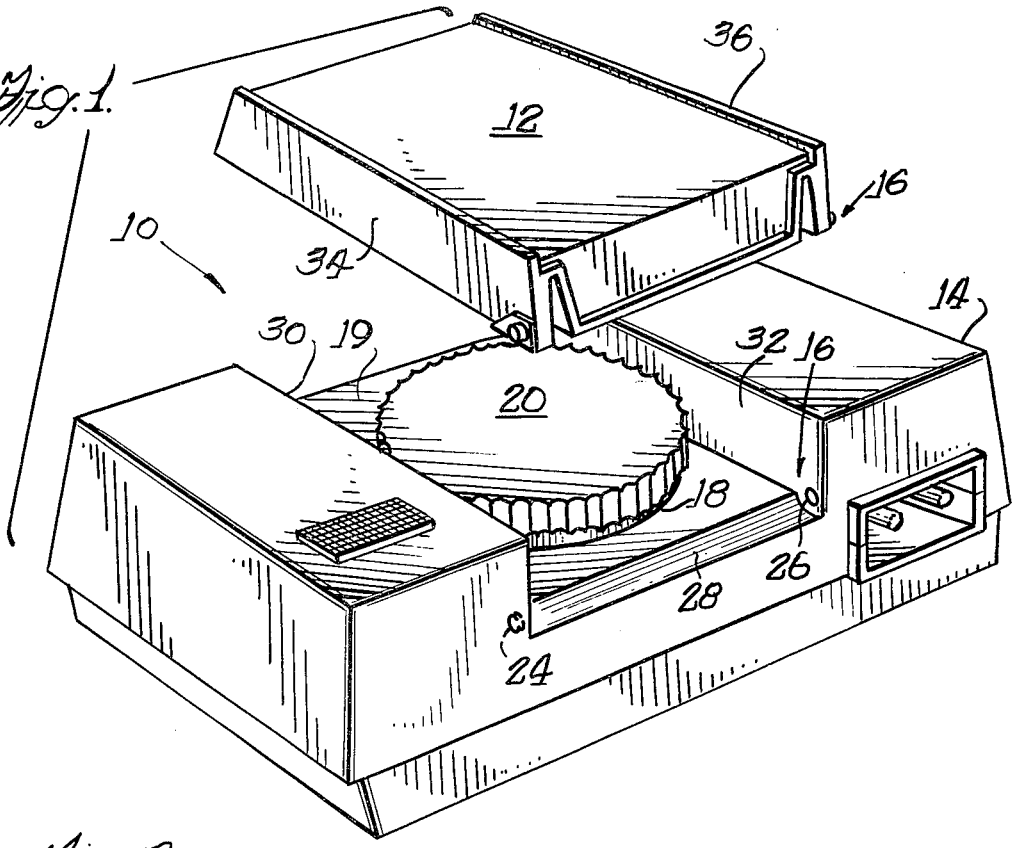
FIG. 1 is an exploded or unassembled perspective view of a contact lens sterilizing unit, in which the cover member is unassembled or exploded with respect to the base member, thereby exposing elements of the hinge structure of this invention.

The description of the hinge structure of this invention is facilitated by reference to the specific embodiment of a lens sterilizer unit, as illustrated in the drawings. It is not desired, however, to limit the invention to use with such a sterilizer unit, as it may be employed with a broad variety of similar designs and structure. Accordingly, it is intended that this invention shall include such alternative embodiments as may occur to those skilled in the art, the invention being defined by the claims appended hereto.

Figure 2:
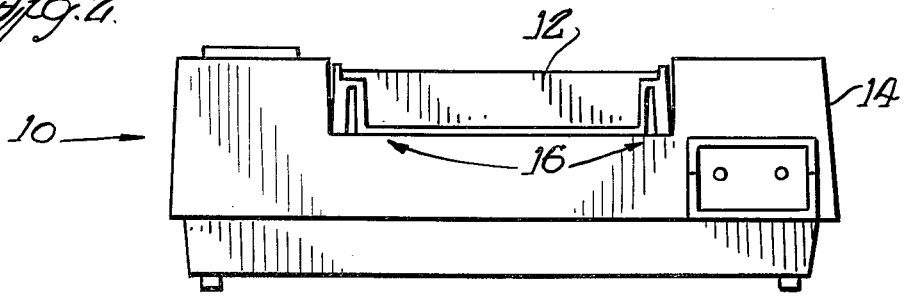
FIG. 2 is a back elevational view of the structure of FIG. 1 in its assembled form.
Figure 3:
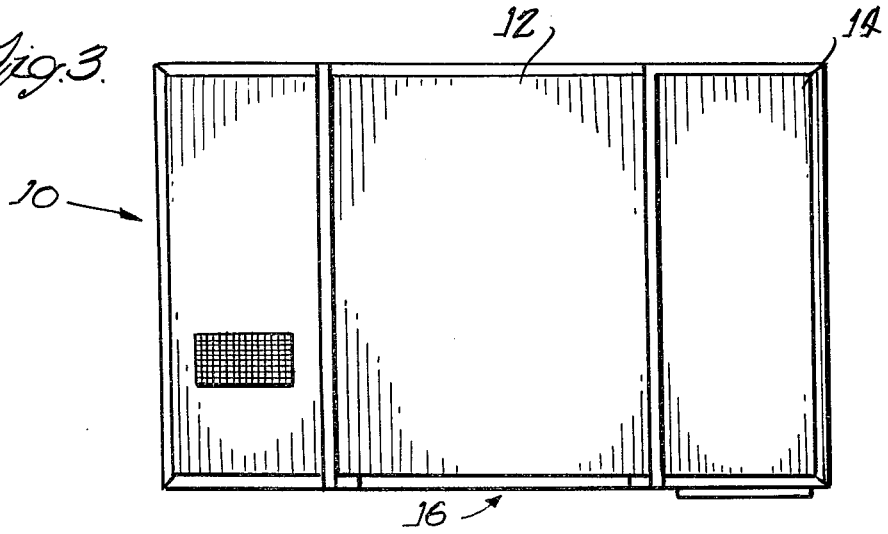
FIG. 3 is a top or plan view of the assembled structure of FIG. 2.

Referring now to the drawings, and initially to FIGS. 1 thru 3, a typical lens sterilizer unit is shown, and designated generally 10. The lens sterilizer unit 10, generally speaking, comprises a cover or lid member 12 and a base or housing member 14. A hinge structure, designated generally 16 in accordance with this invention is utilized to effect hinged mounting of the cover member 14 to the base member 12. The structural details and operational features of the lens sterilizing apparatus 10, aside from those features forming a part of the hinge structure 16, form no part of this invention and need not be described in further detail. Suffice it to say that the base or housing 14 includes a well or receptacle 18 disposed in a platform or flat deck surface 19, which receptacle contains a metallic heating element (not shown). This well or receptacle 18 is formed for accepting a contact lens case 20, which contains a pair of contact lenses immersed in a suitable fluid or solution. Suitable electrical circuits (not shown) are included inside the housing 14 for selectively energizing the heating element, thereby effecting sterilization of the lenses.

The lid or cover 12 is adapted to cooperate with the housing 14 by the action of the hinge structure 16 to provide a selectively openable enclosure for the well or receptacle 18 and the lens case 20 disposed therein. Thus, the lid or cover 12 may be opened to place the lens case 20 within the receptacle 18 and closed, as shown in FIGS. 2 and 3, while the sterilizing process is being carried out.

Figure 5:
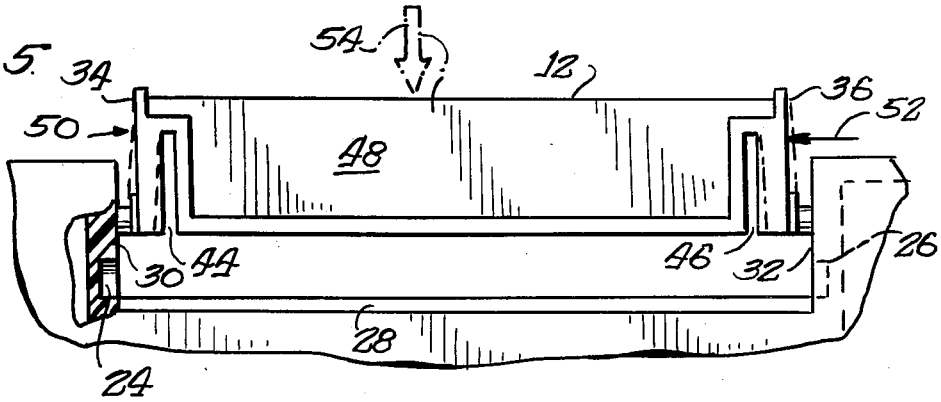
Figure 6:
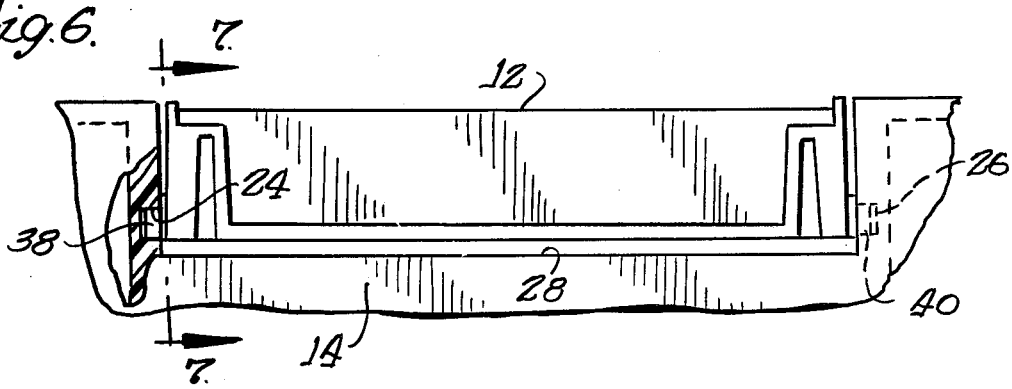
Figure 7:
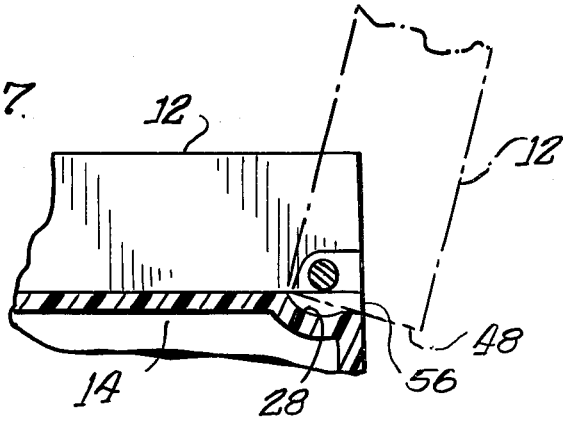
FIG. 7 is a side elevation, in section and partially broken away, taken generally in the plane of the line 7—7 of FIG. 6, and illustrating the operation of the assembled structure of the invention.

Referring now also to FIGS. 4 through 7, the hinge structure 16 is seen to comprise cooperating portions of the respective housing 14 and cover or lid 12. In general, the base member or housing 14 includes a pair of facing, coaxial, and generally cylindrical apertures or hinge knuckle bores, 24 and 26. An elongate groove or channel 28 is provided in the base or housing member 14, running generally between the two apertures or bores 24, 26. This groove 28 is generally arcuate in cross-section, and as shown in FIG. 7 accommodate the pivotal movement of the rear edge of the cover 12. In the illustrated embodiment, the housing 14 includes a pair of upright interior side wall portions 30, 32 which generally enclose the surface deck 19 in which the well or receptacle 18 is located.

Referring now to the cover or lid member 12, a pair of side wall portions 34, 36 thereof are disposed in generally parallel relationship and are spaced apart a sufficient distance to enclose the well or receptacle 18 and lens case 20. The side walls 34, 36 carry a pair of coaxially disposed and oppositedly outwardly projecting rod-like pins or pintle member 38, 40. In the pre-assembled condition, FIG. 4, the pins or pintle members 38, 40 are axially spaced apart, at their inner ends, a distance $X_1$ similar to the axial spacing $X_2$ between the knuckle bores 24 and 26 at the surfaces 30, 32. More specifically, and referring to FIG. 6, when the sterilizer unit is fully assembled, mounted the cover or lid 12 to the base member or housing 14, the pins 38 and 40 are located so as to be pivotally or rotatably mounted within the respective apertures or knuckle bores 24, 26, without the cover 12 being in binding engagement with the wall surface 30 and 32, which might hinder pivotal movement.

Figure 4:
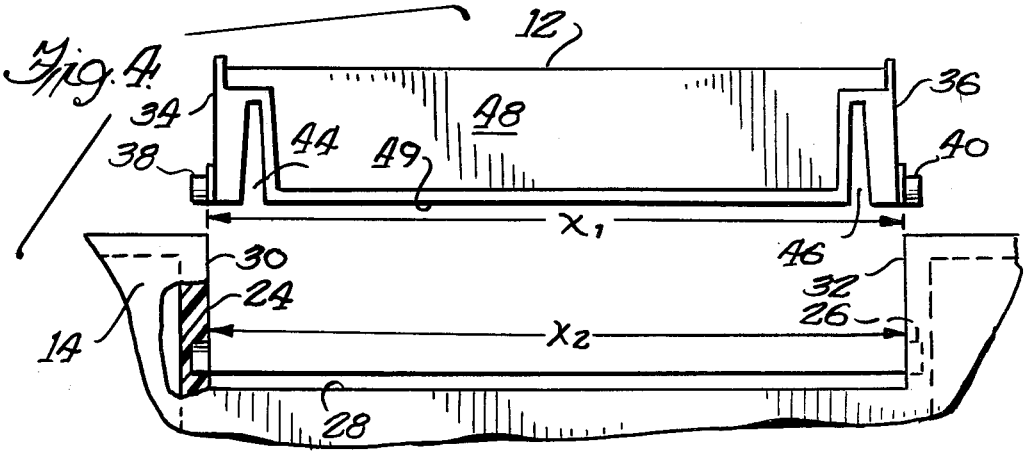
FIG. 4, FIG. 5 and FIG. 6 are back elevational views, partially broken away, illustrating the process of assembly of the cover member with the base member, in accordance with the invention.

Referring now to FIGS. 4 and 5, it shall be noted that the lid or cover member 12 is preferably formed of a relatively resilient yet durable plastics material. Advantageously, the side walls 34 and 36, and more specifically the portions thereof upon which the hinge pins or pintle members 38 and 40 are carried, may be resiliently deformed inwardly to allow assembly with the base member or housing 14, in the manner illustrated in FIGS. 4 through 6. To this end, a pair of generally V-shaped slots or notches 42 and 46 are formed in a back or end wall 48 of the lid or cover member 12. These slots 44, 46 extend vertically, as viewed in FIGS. 4 through 6 over a major portion of the vertical height of back or end wall 48, and are formed generally adjacent the confluence of side walls 34 and 36 with the back wall 48. In this regard, it will be noted that the verical height of walls 34, 36 and 48 are such as to enclose lens case 20 when the cover member 12 is closed.

The process of assembling and hingedly joining the lid or cover member 12 with the base member or housing 14 can be seen in FIGS. 4–6. Initially, as viewed in FIG. 4, the cover member is disposed immediately above the base member 14, with the walls 34 and 36 of the cover member 12 generally in parallel alignment with the walls 30 and 32 of the base member 14. As indicated by arrows 50 and 52 in FIG 5, the side walls 34 and 36, and specifically the portions thereof adjacent or confluent with rear or back wall 48 are depressed or compressed inwardly, the slots 44 and 46 allowing for the deformation required to attain such compression. In FIG. 5, the original positions of the side walls 34 and 36 and slots 44 and 46 are illustrated in dotted line for purposes of comparison with their positions prior to compression in FIG. 4. With sufficient inward compression of side walls 34 and 36, it will be seen that the pins or pintle members 38 and 40 may now be disposed between housing surfaces 30 and 32 and may be moved inwardly sufficiently to effect disposition of the cover member 12 between the walls 30, 32 of the base or housing member 14, in the direction indicated by arrow 54. Referring now specifically to FIG. 6, it will be seen that when the pin or pintle members 38, 40 become aligned with the apertures or knuckle bores 24 and 26, the resilient nature of the cover 12, and particularly the side wall portions 34 and 36 thereof, resiliently returns to its original position. Consequently, the respective pins or pintles 24, 26 are pivotally or rotatably inserted in the respective apertures or knuckles bores 38 and 40, thereby defining the assembled hinge structure 16. Due to the initial sizing of the cover 12, such that the distance between the inner portion of pins 38 and 40, distance $X_1$ in FIG. 4, is equal to or less than the distance between wall surface 30 and 32, distance $X_2$, in the assembled condition of FIG. 6, the cover 12 will not bind against the housing to impede pivotal movement.

It will now be seen that provision of the elongate groove or channel 28 also permits clearance of a back edge portion 49 of the back wall 48 of lid or cover member 12, with respect to the base or housing 14 to allow relative pivotal or hinged movement therebetween. More specifically, relative pivotal or hinged movement of the lid or cover 12, with the base or housing 14 held stationary, is permited. This is best seen in FIG. 7 wherein the lid or cover member 12 is illustrated in solid line in a fully closed position with respect to housing or base member 14, and is illustrated in its fully open position in phantom line. Moreover, it will be remembered that the groove or slot 28 is generally arcuate in cross section, thereby also providing a back stop surface 56, defining the fully open position of cover or lid 12, when the back or rear wall 48 abuts the surface 56.

From the foregoing, it is believed clear that there is provided a relatively simple and inexpensive hinge structure, the parts of which may be molded or otherwise formed from a suitable resilient and durable plastics material. Moreover, it will be seen that assembly of the foregoing parts is simple, and can be accomplished by relatively unskilled workers, without deterring from the reliability of the overall construction.

While the present invention has been described with respect to a specific illustrated embodiment, it is not intended to limit the invention thereto. On the contrary, various changes, modifications, and alternatives, as for example in the form, arrangement or proportions of parts, may suggest themselves to those skilled in the art and possessed of this disclosure. The present invention, therefore, is intended to include all of such changes, modifications or alternatives as fall within the spirit and scope of the claims appended hereto.

The invention is claimed as follows:

1. In combination, a base member, a cover member and hinge structure for hingedly joining said base and cover members, wherein said base member includes upright generally parallel wall surface portions, with each said portion having a knuckle bore formed therein, and said cover member includes at least a pair of side wall portions and an end wall extending between said side wall portions, a rod-like pin member carried by each said side wall portions on a lower segment thereof, said pin members extending oppositely and generally transverse to the outer surface of the associated wall portion, and said rod-like pin members being sized for rotatable disposition in said knuckle bores, said side wall portions of the cover in the pre-assembled state being flared outwardly with the overall dimension from the end of one rod-like member to the other being greater than the distance between said upright wall surface portions of the base member, and said end wall including a slot formed therin generally adjacent the respective confluences of said end wall and said side wall portions, each said slot extending from a location below the upper edge of the end wall and opening through the lower edge of said end wall, thereby enabling said side walls to flex in a resilient manner, such that upon assembly, said end walls may be flexed inwardly to permit said rod-like pin members to be disposed between said upright wall surfaces of the base member and engaged in said knuckle bores, with the resilient nature of said side walls maintaining said engagment while permitting said cover member to pivot relative to said bore member.

2. The combination as recited in claim 1, wherein said base member is a sterilizer unit for contact lenses and includes a heater well for receipt of said lenses, with said coupler member adapted to overlie said heater well when in the closed position.

3. The combination as recited in claim 1, wherein said base member includes a generally horizontal deck portion disposed between said upright parallel wall surface portions, and elongate channel means formed in said deck portion and extending from one upright wall surface portion to the other, said channel means being disposed beneath the cover member end wall to accommodate the edge of said end wall upon pivotal movement of said cover member.

4. The combination as recited in claim 3, wherein said base member is a sterilizer unit for contact lenses, and said generally horizontal deck portion includes a well formed therein for receipt of a lens case, with said cover member overlieing said horizontal deck portion and said heater well when in the closed position.

* * * * *